United States Patent [19]

Kussmaul

[11] Patent Number: 4,920,653

[45] Date of Patent: May 1, 1990

[54] FABRIC MARKING SYSTEM

[76] Inventor: Ernest A. Kussmaul, 146 Sunset Dr., Sayville, N.Y. 11782

[21] Appl. No.: 220,065

[22] Filed: Jul. 18, 1988

[51] Int. Cl.[5] ..... D06H 1/00

[52] U.S. Cl. ..... 33/18.1

[58] Field of Search ..... 33/18.1, 32.5, 666, 33/751; 73/159; 26/70; 156/DIG. 19, DIG. 20, 361, 541, 542, DIG. 33, 563

[56] References Cited

U.S. PATENT DOCUMENTS

| | | | |
|---|---|---|---|
| 3,548,502 | 12/1970 | Baldwin | 33/18.1 |
| 3,644,934 | 2/1972 | Hawkins et al. | 33/18.1 |
| 3,954,543 | 5/1976 | Messmer | 156/DIG. 19 |
| 3,962,730 | 6/1976 | Robinson | 73/159 |
| 4,082,595 | 4/1978 | Slater | 156/361 |
| 4,366,023 | 12/1982 | Voltmer | 156/361 |
| 4,585,506 | 4/1986 | Matsuguchi | 156/361 |

*Primary Examiner*—William A. Cuchlinski, Jr.
*Assistant Examiner*—Chris Fulton
*Attorney, Agent, or Firm*—Thomas R. Morrison

[57] ABSTRACT

A fabric-marking system employs applicator pads resiliently urged into opposed contact with upper and lower surfaces of a fabric for affixing a defect marker onto one or both surfaces of the fabric. The defect markers are supplied on a tape-type carrier strip. The defect markers include a pressure-sensitive adhesive and the carrier strip includes a release coating to permit the defect markers to be stripped therefrom. A leading defect marker is partly stripped from the carrier strip by being passed over a stripper bar. The partially stripped defect marker is disposed between the fabric and its applicator pad. The applicator pad is urged into contact with the portion of the defect marker that projects between the applicator pad and the fabric. Continued motion of the fabric strips the remainder of the defect marker from the carrier strip and the applicator pad irons it in place as it slides therepast. Feeding of either, both or neither of the upper or lower defect markers following a defect marker application may be selectively enabled and inhibited. If the fabric is stationary, feeding of defect markers is inhibited, whereby application of multiple markers in the same location is avoided. Feeding of upper and lower defect markers is controlled independently by label detectors effective for detecting the position of label edges on the carrier strip.

10 Claims, 10 Drawing Sheets

FABRIC MARKING SYSTEM

BACKGROUND OF THE INVENTION

The present invention relates to fabric and machinery for handling fabric. More particularly, the present invention relates to devices and methods for marking areas of a fabric near its edge for denoting defects and the like. The fabric may be knitted, woven or non-woven.

As is well known, when fabric is constructed on a loom, the creation of some localized defects in the fabric is inevitable. In some applications the fabric is wound on a roll as it may be necessary to identify the locations of the defects in the roll.

After finishing, the fabric is unwound from one roll and rolled onto another roll of a conventional inspection machine. A substantial portion of the fabric between the two rolls is open for inspection. An inspector, observing the fabric passing by on the inspection machine, affixes a marker near the edge of the fabric to indicate the lengthwise dimension on the fabric corresponding to the locations of defects. In order to permit the inspector to affix a marker to the fabric, the motion of the fabric must be stopped until the marking operation is completed. The need to stop the fabric for marking, and the substantial time required for the inspector to affix each marker, reduce the productivity of the inspector and inspection machine.

OBJECTS AND SUMMARY OF THE INVENTION

Accordingly, it is an object of the present invention to provide a fabric marking system which overcomes the drawbacks of the prior art.

It is a further object of the invention to provide a fabric marking system which permits affixing defect markers on the fly.

It is a still further object of the invention to provide a fabric marking system effective to affix defect markers selectively on either, or both, sides of a fabric without requiring fabric motion to be halted.

It is a still further object of the invention to provide a fabric marking system for affixing defect markers on the fly, including means for preventing affixation of a marker while the fabric is stationary.

Briefly stated, the present invention provides a fabric-marking system employing applicator pads resiliently urged into opposed contact with upper and lower surfaces of a fabric for affixing a defect marker onto one or both surfaces of the fabric. The defect markers are supplied on a tape-type carrier strip. The defect markers include a pressure-sensitive adhesive and the carrier strip includes a release coating to permit the defect markers to be stripped therefrom. A leading defect marker is partly stripped from the carrier strip by being passed over a stripper bar. The partially stripped defect marker is disposed between the fabric and its applicator pad. The applicator pad is urged into contact with the portion of the defect marker that projects between the applicator pad and the fabric. Continued motion of the fabric strips the remainder of the defect marker from the carrier strip and the applicator pad irons it in place as it slides therepast. Feeding of either, both or neither of the upper or lower defect markers following a defect marker application may be selectively enabled and inhibited. If the fabric is stationary, feeding of defect markers is inhibited, whereby application of multiple markers in the same location is avoided. Feeding of upper and lower defect markers is controlled independently by label detectors effective for detecting the position of label edges on the carrier strip.

According to an embodiment of the invention, there is provided a fabric marking system for marking a fabric, the fabric being one of stationary and in linear motion, comprising: at least one applicator pad disposed facing one surface of the fabric, means for disposing the at least one applicator pad in a selectable one of first and second position, the first position being spaced from the fabric, forming a gap therewith, the second position being in urged contact with the fabric, means for feeding a supply of markers, the supply of markers including a carrier tape having a plurality of markers disposed thereon at generally regular intervals, means for partially stripping one of the markers from the carrier tape to produce a partially stripped marker, an unstripped portion of the defect marker remaining affixed to the carrier tape, the partially stripped portion projecting into the gap, and the applicator pad being effective in the second condition for affixing at least the partially stripped portion to the fabric.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Since fabric-inspection machines, per se, are well known in the art, the details of such machines are omitted herefrom.

Figure 1:
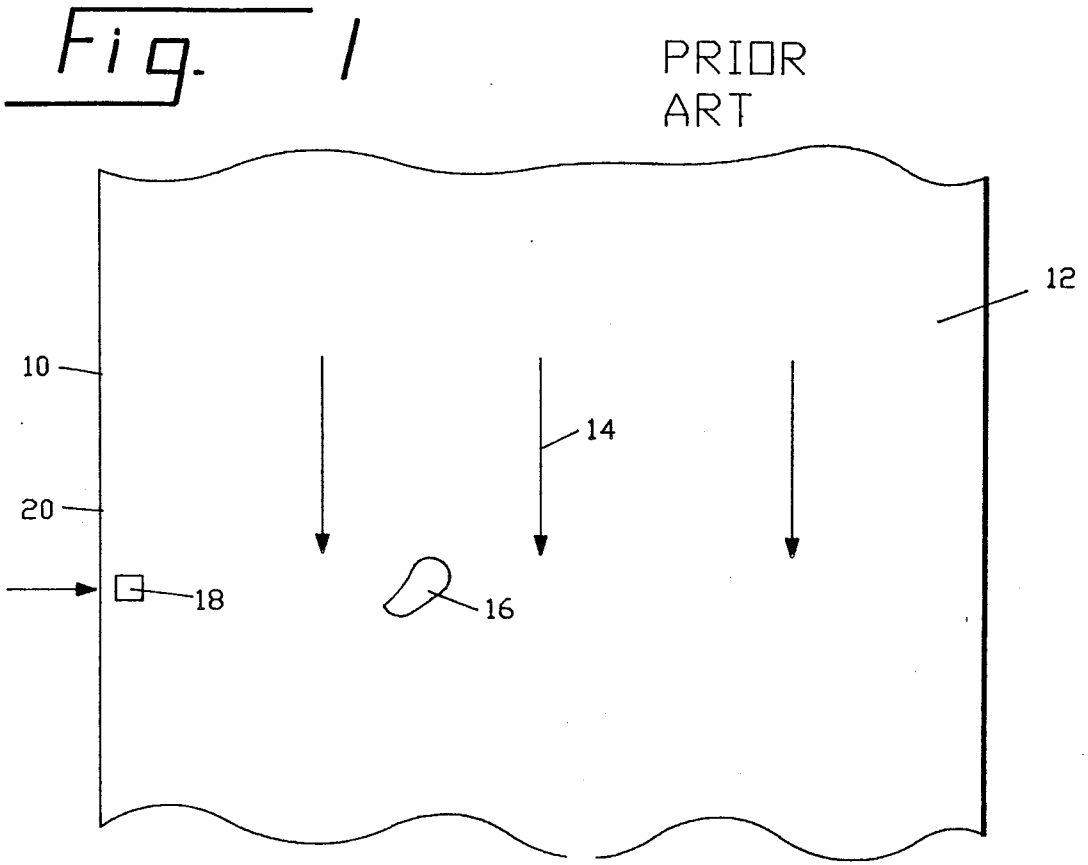
FIG. 1 is a partial front schematic view of a fabric being moved on an inspection machine according to the prior art.

Referring to FIG. 1, there is shown, generally at 10, a fabric passing by on an inspection machine (not otherwise shown). For purposes of understanding, fabric 10 originates on a roll (not shown) and passes in a generally planar portion 12 along a direction indicated by arrows 14, until it is rewound on a second roll (also not shown).

As succeeding portions of fabric 10 traverse planar portion 12, an inspector observes it for the presence of a defect 16. Conventionally, the inspector stops the motion of fabric 10 and affixes a defect marker 18 near an edge 20 thereof. The presence of defect marker 18 may later be sensed either in the roll emerging from the inspection machine, or when the fabric is again unrolled. Defect marker 18 may be of any convenient type and may be affixed by any convenient technique. For example, defect marker 18 may be paper with a contact adhesive on one side. Alternatively, defect marker 18 may be affixed using a wire passed through fabric 10 and twisted to secure it.

The need to stop the motion of fabric 10 for manual affixation of defect marker 18 reduces the efficiency with which fabric 10 is inspected.

Figure 2:
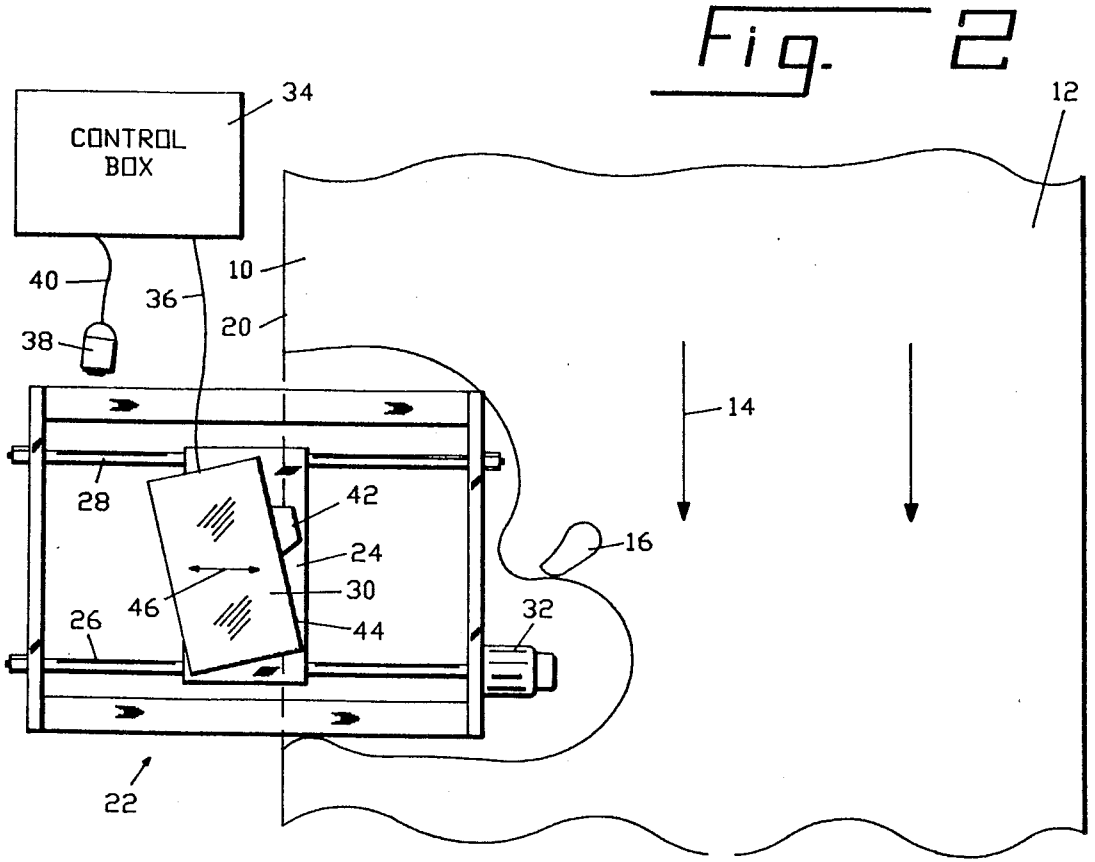
FIG. 2 is a partial front schematic view of an inspection machine including a marking system according to an embodiment of the invention.

Referring now to FIG. 2, a planar portion 12 of fabric 10 is shown passing, as in FIG. 1, in a direction indicated by arrows 14. A defect marking system, shown generally at 22, is mounted stationarily in the inspection machine (not otherwise shown). A carriage 24 is disposed on a drive bar 26 and a guide bar 28. A sensor and marker assembly 30 is disposed on carriage 24. A positioning drive motor 32 is operatively connected for driving carriage 24, together with sensor and marker assembly 30 in the transverse direction in response to transverse motion of edge 20.

A control box 34 is connected to sensor and marker assembly 30 through a cable 36. A manual pushbutton control 38 is connected to control box 34 by a pendant cable 40. A conventional fabric edge sensor 42 is optionally disposed extending beyond an edge 44 of sensor and marker assembly 30. As will become apparent later, sensor and marker assembly 30 includes apparatus responsive to actuation of manual pushbutton control 38 for applying self-adhesive markers (not shown) on one or both surfaces of fabric 10 near edge 20.

As is well known, during the inspection of a roll of fabric 10, edge 20 tends to move transversely. Defect marking system 22 tends to follow such transverse movements in order to retain sensor and marker assembly 30 in the relationship shown. Briefly, as edge 20 departs from a desired position with respect to fabric edge sensor 42, fabric edge sensor 42 applies control signals to positioning drive motor 32 effective to move carriage 24 in a direction that returns the elements to the desired relationship. This motion is indicated by a double-headed arrow 46.

Positioning drive motor 32 may be coupled for driving carriage 24 in any convenient way including, for example, tape or screw drive techniques. In the preferred embodiment, drive bar 26 is a steel cylindrical rod rotatable by positioning drive motor 32. One or more canted bearings (not shown) in carriage 24 ride on the surface of drive bar 26. Due to their cant, the bearing assemblies tend to urge carriage 24 in one direction in response to rotation of drive bar 26 in one direction and reverse the direction of motion in response to reverse rotation.

It will be noted that edge 44 is inclined at an angle with respect to edge 20. Such inclination simplifies the internal arrangement of components in sensor and marker assembly 30. In particular, it simplifies an embodiment of the invention in which it is desired to apply markers both to the upper (facing the viewer in FIG. 2) and lower surfaces of fabric 10. The simplification will become evident later in the present disclosure.

Figure 3:
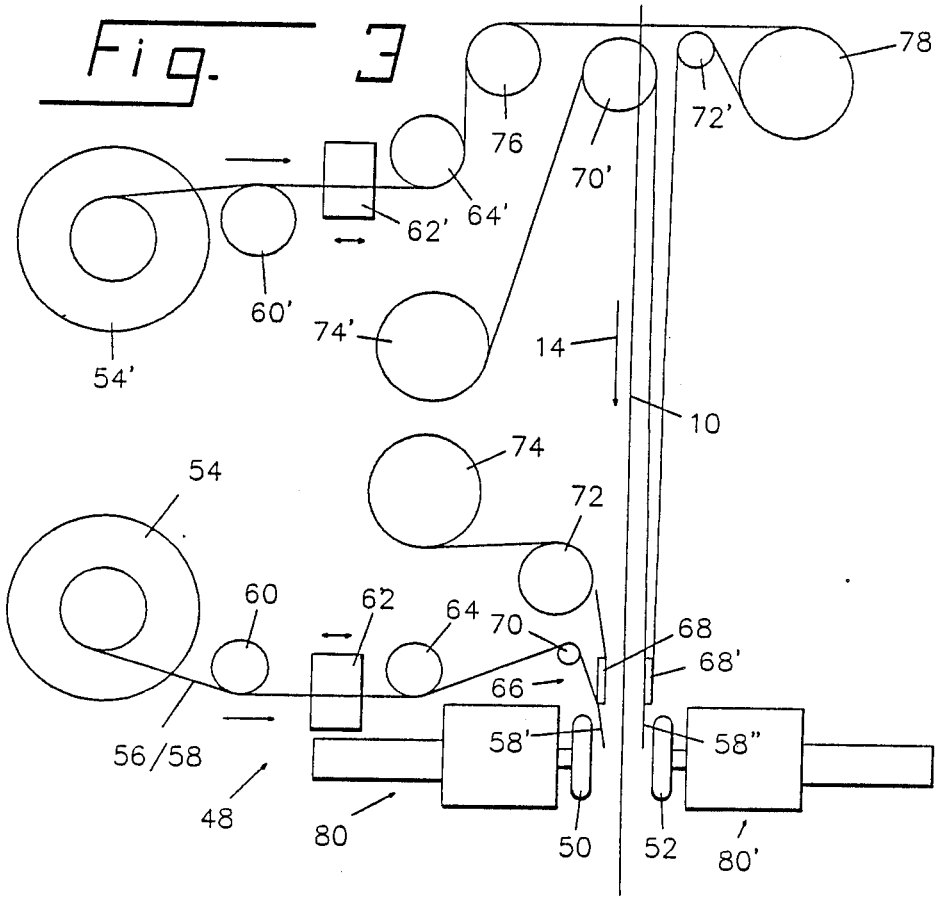
FIG. 3 is a schematic diagram of the feeding path for the marking system of FIG. 2.

Referring now to FIG. 3, a marking apparatus 48 portion of sensor and marker assembly 30 is shown in schematic fashion. Fabric 10 passes between an upper solenoid applicator pad 50 and a lower solenoid applicator pad 52, normally spaced from facing surfaces of fabric 10. An upper marker supply reel 54 contains a supply of a marker carrier 56.

Figure 4:
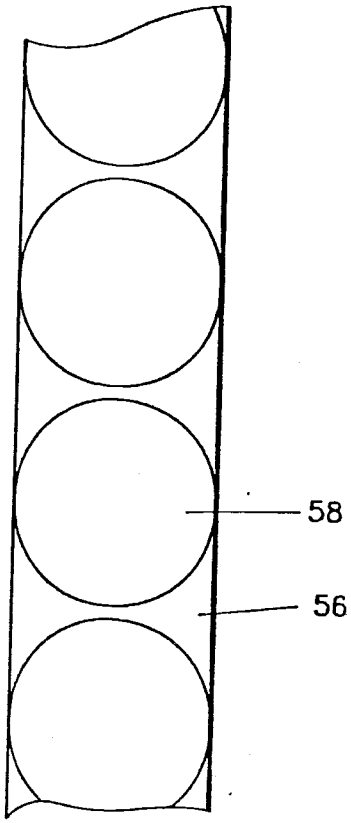
FIG. 4 is a front view of a portion of a carrier tape having a plurality of markers affixed thereto, as used in the invention.

Referring momentarily to FIG. 4, marker carrier 56 includes thereon a plurality of self-adhesive markers 58 thereon. Self-adhesive markers 58 are preferably of a type having a self-adhesive, or contact-adhesive coating thereon effective for adhering to a suitable surface after pressure is applied forcing its adhesive surface into tight contact with the surface to which it is to be affixed. Marker carrier 56 preferably includes a release coating on its surface permitting relatively easy release of self-adhesive markers 58 therefrom.

Although other types of self-adhesive markers 58 are within the contemplation of the invention, in the preferred embodiment, self-adhesive markers 58 are disks of metallic foil, optionally including a colored outer surface to enhance the visibility thereof. Marker carrier 56 is preferably a translucent paper or plastic material. Metallic foil has two principal advantages. First, being opaque, metallic foil, when used with translucent marker carrier 56, permits the use of optical methods for detecting the edges of self-adhesive markers 58 for use in controlling the advance of marker carrier 56. Second, metallic foil is readily detectable by conventional metal sensors, thus enabling use of such sensors to identify locations on fabric 10 in a subsequent high-speed trimming or mapping operation.

Returning now to FIG. 3, marker carrier 56 (with self-adhesive markers 58 affixed thereto) is fed over a guide roller 60 and through an optical marker sensor 62. Downstream of optical marker sensor 62, marker carrier 56 passes over a second guide roller 64 before entering a marker stripper 66.

Figure 5:
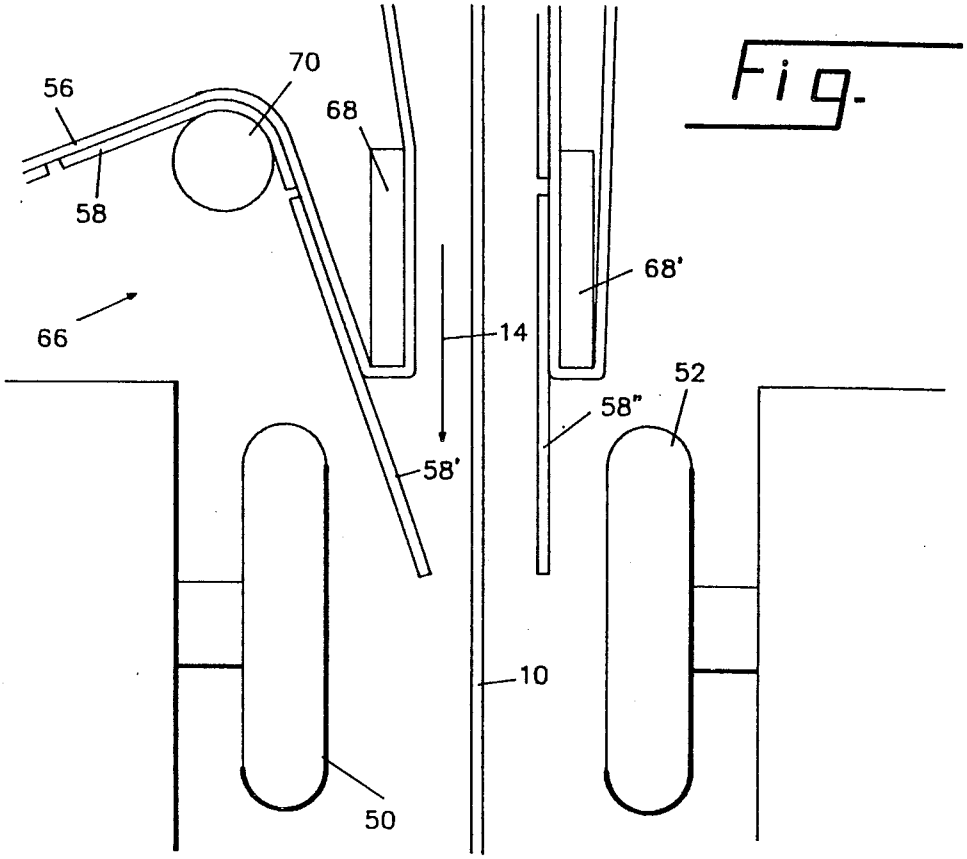
FIG. 5 is an enlarged view of the applicator pads and marker strippers of FIG. 3 in the inoperative position.

Referring now to FIG. 5, marker stripper 66 includes a stripper bar 68 having a long cross-sectional dimension generally parallel to the facing surface of fabric 10, and a thin cross sectional dimension at right angles to the surface of fabric 10. An entry guide roller 70 is positioned to force marker carrier 56 to approach stripper bar 68 at an acute angle to the long dimension of stripper bar 68. Marker carrier 56 is pulled away from marker stripper 66 generally parallel to the facing surface of fabric 10. The resulting sharp change in direction over such a small travel distance applies forces to the adhesive affixing a leading self-adhesive marker 58' to marker carrier 56, that self-adhesive marker 58' is partly separated from marker carrier 56, whereby a portion thereof projects between upper solenoid applicator pad 50 and fabric 10.

Returning now to FIG. 3, marker carrier 56 continues over a further guide roller 72 and is wound up on a take-up reel 74. Take-up reel 74 is preferably power driven in a conventional manner to control the advance of marker carrier 56 in a manner to be described.

A self-adhesive marker 58'' is fed and stripped between fabric 10 and lower solenoid applicator pad 52 in a manner analogous to that described above. Elements having functions corresponding to those described are identified with the same reference numerals primed. Thus, the primed elements require no further description. First and second crossing rollers 76 and 78 are added to guide marker carrier 56 from the front side to the rear side of fabric 10. It will be noted that crossing rollers 76 and 78 are disposed a substantial distance in the upstream direction of travel of fabric 10, with respect to lower solenoid applicator pad 52. The inclination of edge 44 (FIG. 2) clears this crossing while permitting the entire supply and takeup portions servicing the lower markers to be disposed over the upper surface of fabric 10. This simplifies installation and removal of supplies and avoids the complication of requiring a separate feed and takeup mechanism below the lower surface of fabric 10.

Figure 6:
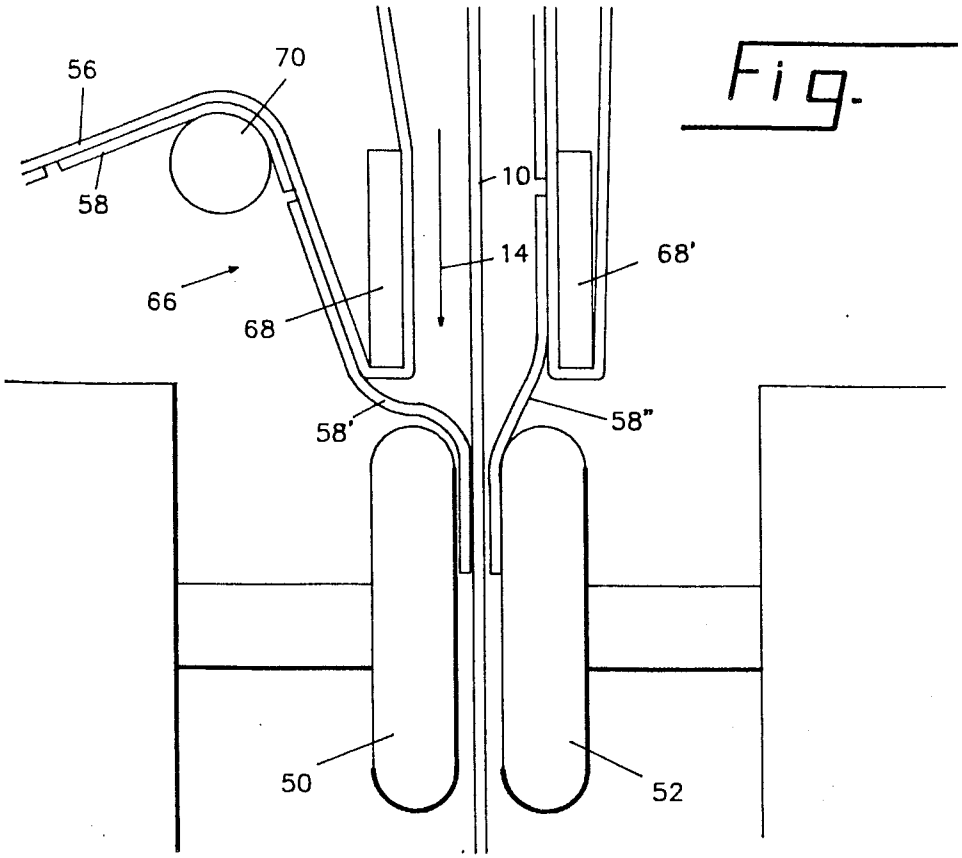
FIG. 6 is an enlarged view corresponding to FIG. 5 with the applicator pads urged toward the application position.
Figure 7:
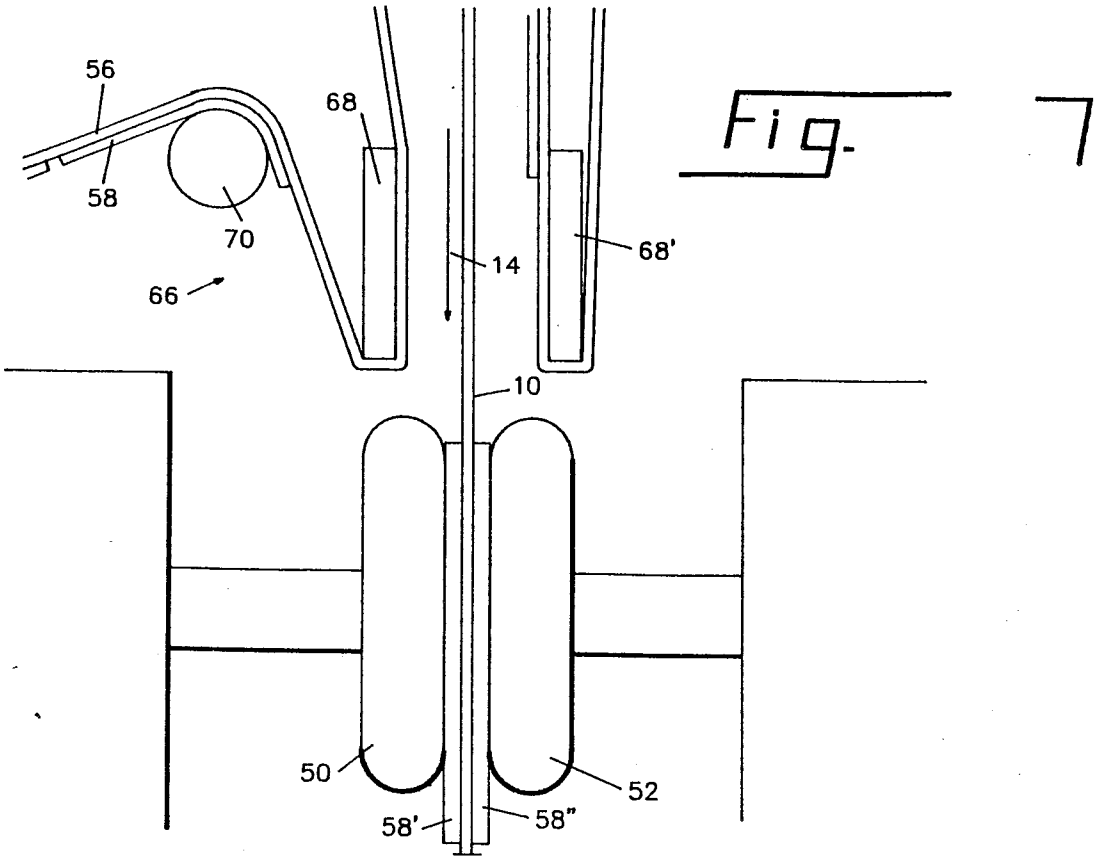
FIG. 7 is an enlarged view corresponding to FIGS. 5 and 6 after the markers have been stripped from the carrier tapes by motion of the fabric.

In the quiescent condition shown in FIG. 3 fabric 10 continues to pass between upper solenoid applicator pad 50 and lower solenoid applicator pad 52 with self-adhesive markers 58' and 58'' partially stripped and awaiting actuation. The actuation sequence is shown in FIGS. 6 and 7, to which reference is now made.

When actuated by operation of manual pushbutton control 38 (FIG. 2), both upper solenoid applicator pad 50 and lower solenoid applicator pad 52 are advanced toward fabric 10. FIG. 6 illustrates the situation just before upper solenoid applicator pad 50 and lower solenoid applicator pad 52 come into opposing contact through fabric 10 and self-adhesive markers 58' and 58''. Since self-adhesive markers 58' and 58'' project between fabric 10 and upper solenoid applicator pad 50 and lower solenoid applicator pad 52, respectively, leading portions of self-adhesive markers 58' and 58'' are pressed toward fabric 10 which, as indicated by arrow 14 is in motion in the downward direction in the figure. When firm contact is made, the tacky contact adhesive on the surfaces of self-adhesive markers 58' and 58'' adheres to the surfaces of fabric 10. Since, as noted above, marker carrier 56 is coated with a release coating, the adhesive attachment of self-adhesive markers 58' and 58'' is much greater to fabric 10 than it is to their respective marker carriers 56. As shown in FIG. 7, continued motion of fabric 10 strips self-adhesive markers 58' and 58'' from their respective marker carriers 56. Upper solenoid applicator pad 50 and lower solenoid applicator pad 52 continue to press against them as they advance, whereby the remaining portions of self-adhesive markers 58' and 58'', not originally contacted and affixed to fabric 10, are ironed into place by the continued urging between lower solenoid applicator pad 50 and lower solenoid applicator pad 52. After a period of time sufficient to attain full application, as shown in FIG. 7, upper solenoid applicator pad 50 and lower solenoid applicator pad 52 are again moved away from fabric 10.

Returning now to FIG. 3, upon completion of the sequence just described, take-up reel 74 and take-up reel 74' are energized to advance their respective marker carriers 56 until the next self-adhesive markers 58 thereon are moved into the partially stripped positions corresponding to self-adhesive markers 58' and 58''. Accuracy in positioning is attained using optical marker sensors 62 and 62'. In one embodiment, optical marker sensor 62, as typical of both, includes an infra-red source positioned on one side of marker carrier 56 and an infra-red detector positioned on the other side. As long as the transmission of infra-red radiation is blocked by a self-adhesive marker 58, optical marker sensor 62 enables take-up reel 74 to continue taking up marker carrier 56. As a gap between adjacent stripper bars 68 reaches optical marker sensor 62, optical marker sensor 62 removes the enabling signal from take-up reel 74, thereby halting further movement of marker carrier 56 with its leading self-adhesive markers 58' at the partially stripped position shown. It will be clear to one skilled in the art that vernier adjustment of the positioning of self-adhesive markers 58' and 58'' may be achieved by controlling the positions of optical marker sensors 62 and 62', so that the aligned attachment shown in FIG. 7 may be achieved.

In some applications, it may be desirable to affix only one self-adhesive marker 58, either on the upper or lower surface of fabric 10. This is readily attainable by selectively enabling operation of take-up reel 74 and/or take-up reel 74'. If, for example, take-up reel 74 is enabled and take-up reel 74' is inhibited, completion of an operation, as described above, results only in the advance of a next self-adhesive marker 58 from upper marker supply reel 54 into the stripped position shown. Being inhibited, take-up reel 74' does not advance a self-adhesive marker 58 into the position illustrated by self-adhesive marker 58''. Accordingly, only self-adhesive marker 58' is affixed to fabric 10. The reverse of this operation may be attained by enabling take-up reel 74' and inhibiting take-up reel 74. Selective enablement may be achieved using a suitable switch (not shown) on control box 34 (FIG. 2). If it is known beforehand that self-adhesive markers 58 are to be installed on the upper surface of fabric 10, marker carrier 56 may be omitted from upper marker supply reel 54' and the remainder of the path leading to the lower surface of fabric 10.

If fabric 10 is stationary, operation of marking apparatus 48 is preferably inhibited since, otherwise, continued actuation of manual pushbutton control 38 (FIG. 2) may apply a plurality of overlapping self-adhesive markers 58 in one place. As will be detailed hereinafter, a motion sensor inhibits actuation of marking apparatus 48 in the absence of motion of fabric 10. In one embodiment, one or more actuations of manual pushbutton control 38 when fabric 10 is stationary stores a single actuation signal whose execution is delayed until motion of fabric 10 is detected. Thus, if a defect is discovered in a stationary fabric 10 at a location aligned with marking apparatus 48, manual pushbutton control 38 may be actuated. When motion of fabric 10 is resumed, execution of the command is performed to apply a self-adhesive marker 58 to one or both sides of fabric 10. Alternatively, instead of inhibiting actuation of upper solenoid applicator pad 50 and lower solenoid applicator pad 52, actuation of take-up reels 74 and/or 74' may be inhibited in the absence of motion. In this manner, if an attempt is made to affix one or both self-adhesive markers 58 while fabric 10 is stationary, this is permitted. However, application of a further self-adhesive marker 58 at the same point is inhibited since, with take-up reels 74 and 74' inhibited, the next self-adhesive markers 58 are not fed into the stripped position until after motion of fabric 10 is resumed.

In order to attain uniform attachment of self-adhesive markers 58 over a range of thicknesses of fabric 10, and other variables, it is desirable that means be provided for resilient urging of upper solenoid applicator pad 50 and lower solenoid applicator pad 52 in opposition to each other. Upper solenoid applicator pad 50 and lower soleoid applicator pad 52 are controlled in an identical manner, thus, only the control device for upper solenoid applicator pad 50 is shown and described in detail.

Figure 8:
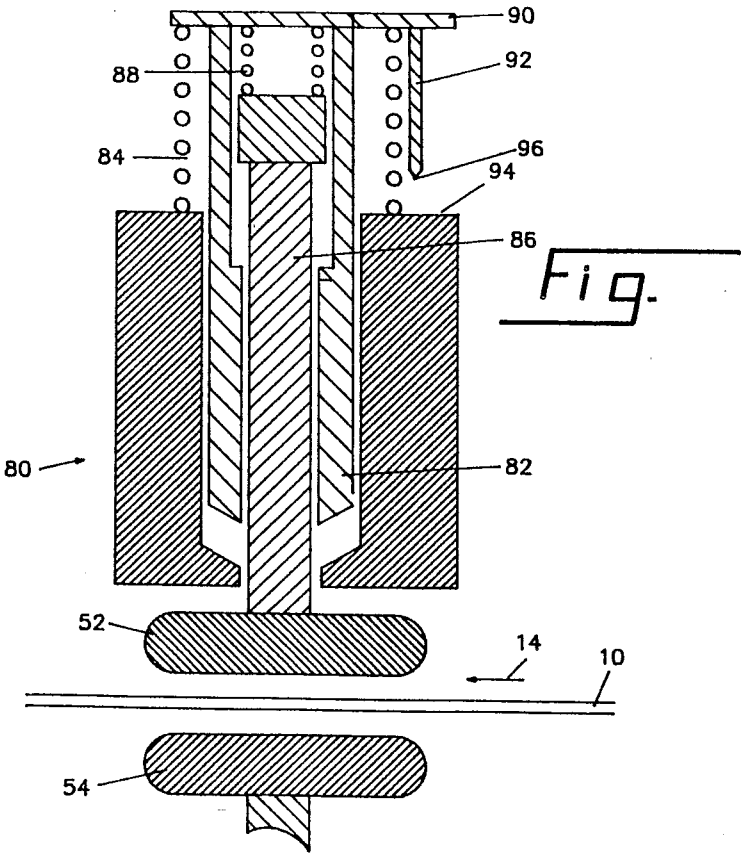
FIG. 8 is a cross section of one of the solenoids of FIG. 3, shown in the inoperative position of FIG. 5.

Referring now to FIG. 8 a spring-loaded solenoid 80 is shown in the quiescent condition with upper solenoid applicator pad 50 spaced from fabric 10. A plunger 82 is urged in the outward direction by a return spring 84. A shaft 86, attached to upper solenoid applicator pad 50, is urged outward by a pressure spring 88 operatively affixed to plunger 82 by a plate 90. A spacer pin 92 projects from plate 90 toward a surface 94. In the condition shown, an end 96 of spacer pin 92 is spaced a predetermined distance from surface 94.

Figure 9:
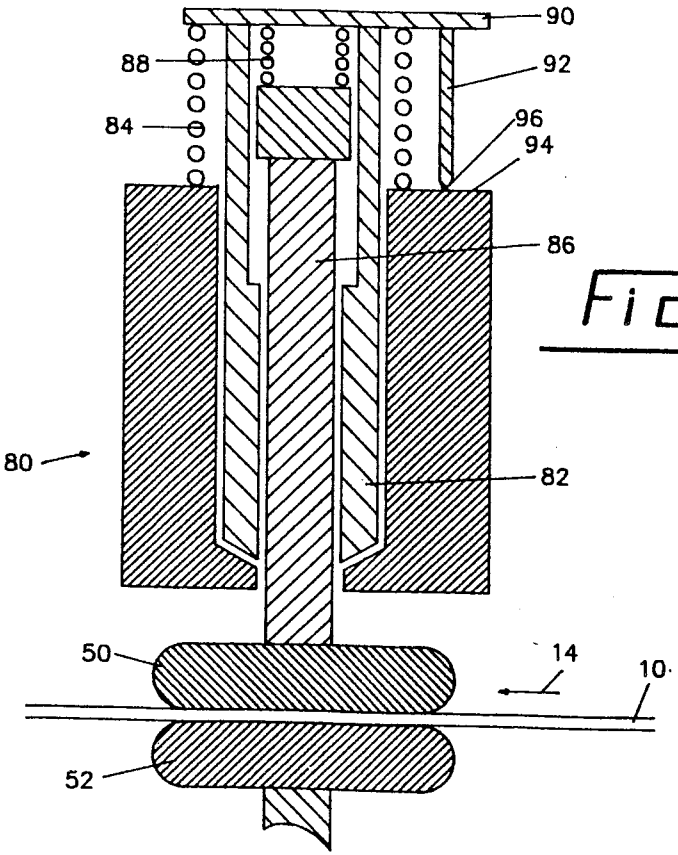
FIG. 9 is a cross section of the solenoid of FIG. 8 in the operative position.

Referring now to FIG. 9, when energized, solenoid 80 urges plunger 82 toward arrow 14 until motion is stopped by contact of end 96 with surface 94. A resilient force is applied through pressure spring 88 to shaft 86, thereby resiliently urging upper solenoid applicator pad 50 against a surface of fabric 10 (sometimes with a self-adhesive marker 58, not shown, therebetween). By appropriate selection of a spring constant in pressure spring 88 and an adjustment of the projection of spacer pin 92, a desired force is applied to upper solenoid applicator pad 50 (and lower solenoid applicator pad 52) which is relatively independent of the thickness of fabric 10. The resilient force is especially desirable for maintaining a uniform force on upper solenoid applicator pad 50 and lower solenoid applicator pad 52, whereby the one or two self-adhesive markers 58 are ironed in place as fabric 10 continues in motion. Upper solenoid applicator pad 50 and lower solenoid applicator pad 52 are maintained in the ironing position shown for a time long enough to permit substantially full attachment of self-adhesive marker 58. The timing is not particularly critical, however. Thus, a fixed timing interval is satisfactory to accommodate a substantial range of speeds of fabric 10. While upper solenoid applicator pad 50 and lower solenoid applicator pad 52 are in the ironing position shown, it is preferred that the feeding mechanisms for feeding the next self-adhesive markers 58 be inhibited.

Figure 10:
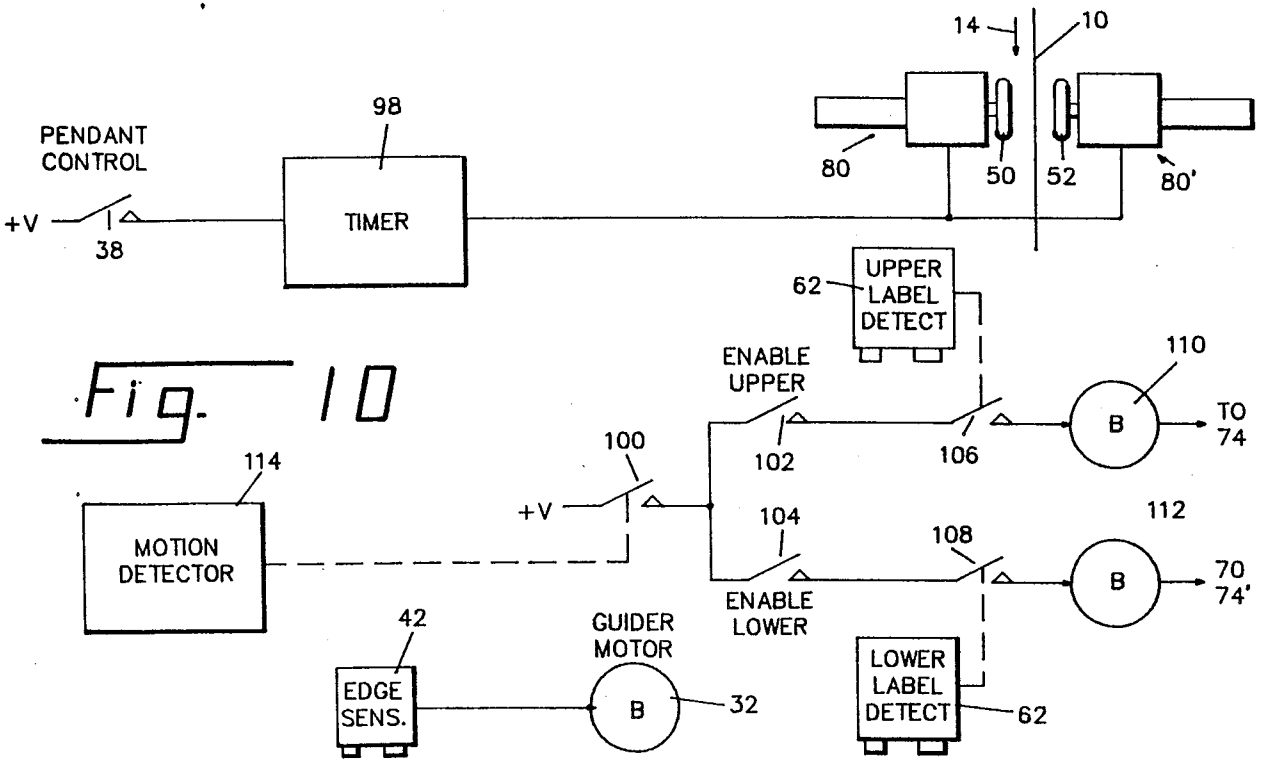
FIG. 10 is a schematic diagram of the control system for the marking system according to the present invention.

Referring now to FIG. 10, manual pushbutton control 38 provides a triggering input to a timer 98. A fixed-period output pulse from timer 98 is applied in parallel to solenoids 80 and 80', whereby upper solenoid applicator pad 50 and lower solenoid applicator pad 52 are urged into the ironing position for the period of the pulse. A voltage source +V is connected through a feed-control switch 100 in parallel to terminals of an upper enable switch 102 and a lower enable switch 104. Second terminals of upper enable switch 102 and lower enable switch 104 are connected to terminals of upper label feed control switch 106 and lower label feed control switch 108. A second terminal of upper label feed control switch 106 is connected to an upper label drive motor 110 whose output is connected mechanically to take-up reel 74 (FIG. 2). Similarly, a second terminal of lower label feed control switch 108 is connected to a lower label drive motor 112 whose output is connected mechanically to take-up reel 74'. Optical marker sensor 62 controls an upper label feed control switch 106 and optical marker sensor 62' controls lower label feed control switch 108. Fabric edge sensor 42 controls positioning drive motor 32 in a conventional manner.

A lower label feed control switch 114 responds to a stationary condition of fabric 10 by opening the contacts of feed-control switch 100.

In operation, actuation of manual pushbutton control 38 triggers timer 98 into producing a fixed-period output pulse effective for energizing solenoids 80 and 80' for the same period. While fabric 10 is in motion, lower label feed control switch 114 maintains feed-control switch 100 in the closed condition, whereby power is applied to succeeding elements. Upper enable switch 102 and lower enable switch 104 are closed or opened as desired to enable or inhibit any combination of upper and lower label placement. If upper enable switch 102 is closed and lower enable switch 104 is opened, then only an upper label is applied in the next operation since no lower label is fed into the stripped position for application. If the conditions of upper enable switch 102 and lower enable switch 104 are reversed, the opposite conditions are achieved. It is within the scope of the invention to permit both upper enable switch 102 and lower enable switch 104 both to be set to the open position. In this condition, solenoids 80 and 80' may be operated, for example, for test purposes, without applying a label in either position.

At the end of the timing cycle produced by lower label feed control switch 114, enabled ones of upper label drive motor 110 and lower label drive motor 112 begin a feeding cycle by driving their respective take-up reel 74 and/or 74'. Upper label drive motor 110, if enabled, continues driving take-up reel 74 until upper label feed control switch 106 is opened by optical marker sensor 62 detecting the presence of a self-adhesive marker 58 in the triggering position. Similarly, lower label drive motor 112, if enabled, continues driving take-up reel 74' until lower label feed control switch 108 is opened by optical marker sensor 62' detecting the presence of a self-adhesive marker 58 in the triggering position. Independent control of upper label drive motor 110 and lower label drive motor 112 in this manner permits independent adjustment of the stripped positions of their respective self-adhesive markers 58. Thus, if adjustment is required to align the positions of upper and lower self-adhesive markers 58, such adjustment can be performed on one or both feed assemblies.

One skilled in the art will recognize that one of upper solenoid applicator pad 50 and lower solenoid applicator pad 52 could be replaced by a stationary back-up plate (not shown) spaced from fabric 10. In such an embodiment, actuation of upper solenoid applicator pad 50 is effective to displace fabric 10 sufficiently so that application of a self-adhesive marker 58 on either side, or on both sides, in a manner similar to that previously described. Fabric 10 is displaced slightly toward the stationary back-up plate during this process.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What I claim is:

1. A fabric marking system for marking a fabric, said fabric being one of stationary and in linear motion, comprising:

first and second applicator pads in opposition facing first and second surfaces of said fabric;

means for disposing said first and second applicator pads in a selectable one of first and second positions;

said first position being spaced from said fabric, forming a gap therewith;

said second position being in urged contact with said fabric;

means for feeding a supply of markers;

said supply of markers including a carrier having a plurality of markers disposed thereon at generally regular intervals;

means for partially stripping one of said markers from said carrier to produce a stripped portion, an unstripped portion of said marker remaining affixed to said carrier;

said stripped portion projecting into said gap; and said first and second applicator pads being effective in said second position for affixing at least said stripped portion of said fabric.

2. A fabric marking system according to claim 1, wherein said means for disposing first and second applicator pads in said second condition includes means for maintaining said first and second applicator pads in said second position for a time sufficient to strip said unstripped portion from said carrier.

3. A fabric marking system according to claim 2 wherein said means for disposing said first and second applicator pads in said second position further includes means for maintaining said applicator pad in said second position for a sufficient time to affix a desired portion of said marker to said fabric.

4. A fabric marking system according to claim 1 wherein said means for feeding a supply of markers includes means for preventing said affixing in an absence of motion of said fabric.

5. A fabric marking system according to claim 4 wherein said means for preventing includes means for inactivating said means for feeding in an absence of motion of said fabric.

6. A fabric marking system according to claim 1 wherein said means for feeding includes:

means for sensing a predetermined portion of one of said markers on said carrier; and means for advancing said carrier until said predetermined portion is sensed.

7. A fabric marking system for marking a fabric, said fabric being one of stationary and in linear motion, comprising:

at least one applicator pad disposed facing one surface of said fabric;

means for disposing said at least one applicator pad in a selectable one of first and second positions;

said first position being spaced from said fabric, forming a gap therewith;

said second position being in urged contact with said fabric;

first means for feeding a first leading marker of a first supply of markers adjacent an upper surface of said fabric;

second means for feeding a second leading marker of a second supply of markers adjacent a lower surface of said fabric; and said first and second leading markers being generally aligned whereby said applicator pad in said second position is effective for affixing both said first and second leading markers to opposed surfaces of said fabric;

said supply of markers including a carrier having a plurality of markers disposed thereon at generally regular intervals;

means for partially stripping one of said markers from said carrier to produce a stripped portion, an unstripped portion of said marker remaining affixed to said carrier;

said stripped portion projecting into said gap; and said applicator pad being effective in said second position for affixing at least said stripped portion of said fabric.

8. The fabric marking system according to claim 7, wherein said at least one applicator pad includes first and second applicator pads in opposition facing first and second surfaces of said fabric.

9. The fabric marking system according to claim 7, further including independent enablement of said first and second means, whereby any combination of said first and second leading markers may be affixed to said fabric.

10. The fabric marking system according to claim 11, further including independent enablement of said first and second means, whereby any combination of said first and second leading markers may be affixed to said fabric.

* * * * *